United States Patent [19]

Prueter

[11] 4,121,833

[45] Oct. 24, 1978

[54] GOLF CLUB PUTTER

[76] Inventor: John L. Prueter, 1415 Toledo Ave. North, Minneapolis, Minn. 55422

[21] Appl. No.: 784,120

[22] Filed: Mar. 31, 1977

[51] Int. Cl.[2] ..... A63B 53/04

[52] U.S. Cl. ..... 273/175; 273/167 C; 273/167 G

[58] Field of Search ..... 273/77 R, 78, 80 C, 273/164, 167–175

[56] References Cited

U.S. PATENT DOCUMENTS

| | | | |
|---|---|---|---|
| D. 196,736 | 10/1963 | DeCarlo | 273/167 D X |
| D. 229,204 | 11/1973 | Romero | 273/167 D X |
| 1,250,296 | 12/1917 | Fitzjohn et al. | 273/167 G X |
| 1,511,479 | 10/1924 | Kelly et al. | 273/175 |
| 1,703,199 | 2/1929 | McClure | 273/164 X |
| 2,023,885 | 12/1935 | Hinckley | 273/175 X |
| 2,395,837 | 3/1946 | Baymiller et al. | 273/175 |
| 2,665,909 | 1/1954 | Wilson | 273/175 X |
| 3,516,674 | 6/1970 | Scarborough | 273/171 X |
| 3,578,332 | 5/1971 | Caldwell | 273/78 X |
| 3,625,518 | 12/1971 | Solheim | 273/175 |
| 3,700,244 | 10/1972 | Liotta | 273/175 X |
| 3,758,115 | 9/1975 | Hoglund | 273/167 A X |
| 3,759,527 | 9/1973 | Witherspoon | 273/175 X |
| 3,908,996 | 9/1975 | Molinaro | 273/167 C X |
| 3,989,257 | 11/1976 | Barr | 273/175 |

OTHER PUBLICATIONS

"Gold World"; Jan. 4, 1972; p. 36.

*Primary Examiner*—Richard J. Apley
*Attorney, Agent, or Firm*—Orrin M. Haugen; Thomas J. Nikolai

[57] ABSTRACT

A golf putter including the conventional shaft having a gripping handle at one end and a ball striking head at the other wherein the ball striking head comprises a body with a shaft engaging bore for receiving the shaft, and a ball striking surface disposed remotely from the shaft engaging bore. The ball striking surface has the configuration of a cylindrical segment of substantially constant radius, intersecting a plane extending through the axis of said shaft along said gripping handle portion and generally parallel to a plane tangent of said ball striking surface at the arcuate center thereof. The magnitude of the radius is preferably between 2½ inches and 3½ inches, although radii of up to about 4½ inches may be useful, with most universal acceptance being a radius of substantially 3 inches.

1 Claim, 34 Drawing Figures

FIG. 23
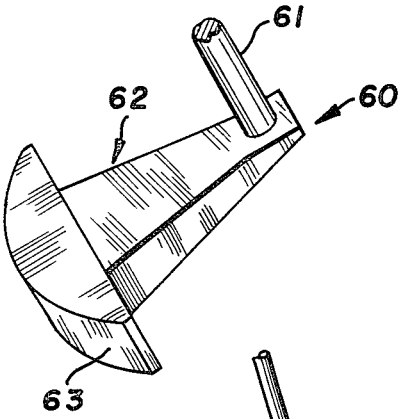
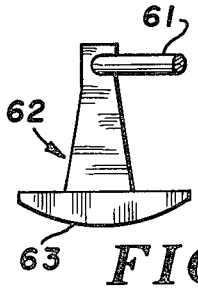
FIG. 24
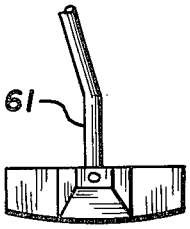
FIG. 28
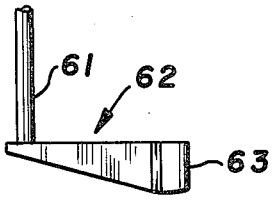
FIG. 27
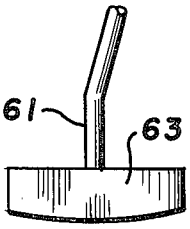
FIG. 25
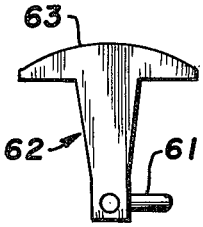
FIG. 26
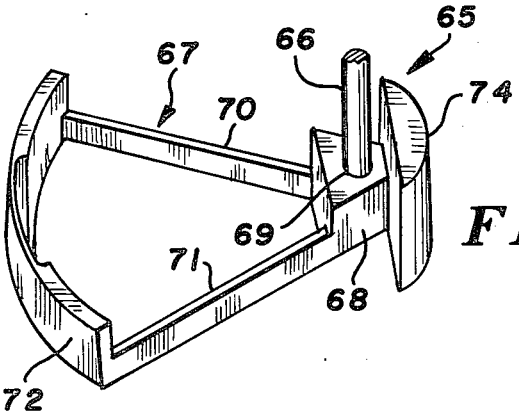
FIG. 29
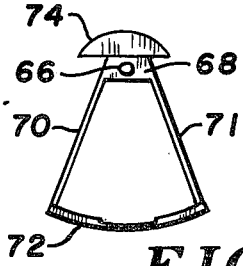
FIG. 30
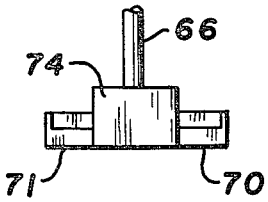
FIG. 34
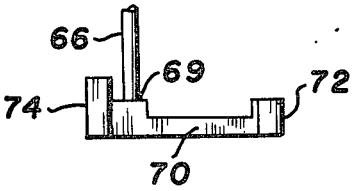
FIG. 33
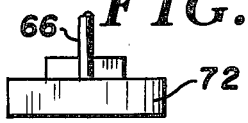
FIG. 31
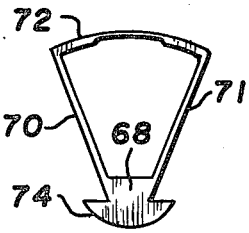
FIG. 32

GOLF CLUB PUTTER

BACKGROUND OF THE INVENTION

The present invention relates generally to an improved golf putter, and more particularly to an improved golf putter structure which permits putts to be completed which are directionally accurate, in spite of inadvertent twisting of the face of the club during the stroking operation.

Most golfers experience problems with their putts from time to time. Freqently the problems can be attributed to an inadvdertent twisting of the shaft during the completion of the stroke, with such inadvertent twisting of the club shaft providing an inaccurately directed putt. Generally, putters are provided with a substantially planar ball striking surface, although some putters have been designed with somewhat modified or curved configurations.

SUMMARY OF THE INVENTION

In accordance with the present invention, a putter is provided with a ball striking head which includes a ball striking surface along one face thereof. The ball striking surface has the general configuration of a cylindrical segment of substantially constant radius, thereby enabling the golfer to accommodate such inadvertent twists of the golf club without adversely affecting the directional aspects of the putt. Accordingly, if the golfer inadvertently twists the golf shaft during the putting stroke, such twisting will have no affect upon the directional aspect given to the golf ball upon being struck by the ball striking surface of the putter. In other words, the ball striking surface will always provide a proper direction of drive to the ball, in spite of any inadvertent twisting of the shaft, which would otherwise adversely affect the directional aspects of the putt if a conventional or even slightly modified ball striking surface were provided.

More specifically, the golf putter of the present invention has a ball striking head which is adapted to engage the club shaft, and furthermore which has a ball striking surface remotely disposed from the point at which the shaft engages the head. The ball striking surface, as previously indicated, is preferably in substantially the form of a cylindrical segment of substantially constant diameter, and furthermore the axis of the cylindrical segment forming the ball striking surface intersects a plane extending through the axis of said shaft along said gripping handle portion and generally parallel to a plane tangent of said ball striking surface at the arcuate center thereof. For most golfers, the magnitude of the radius of arc from the axis of the shaft engaging zone to the surface is between 2½ inches and 3 inches, although radii of up to about 4½ inches may be useful, with a preferred radius being approximately 3 inches. Such a radius appears to be universally acceptable for golfers, and is of a magnitude which accommodates the normal inadvertent twisting which plagues most golfers from time to time.

Therefore, it is a primary object of the present invention to provide an improved golf putter having a shaft with a gripping handle at one end and a ball striking head at the other, and with the ball striking head having a ball striking surface which is substantially in the form of a cylindrical segment.

It is a further object of the present invention to provide an improved golf putter which has a ball striking surface in the form of a cylindrical segment, and which configuration accommodates inadvertent twisting of the shaft by the golfer during the putting stroke, without adversely affecting the directional accuracy of the putt.

It is yet a further object of the present invention to provide an improved golf putter which is provided with a ball striking surface having substantially the form of a cylindrical segment, the radius of the cylindrical segment being substantially constant, and being centered along a portion of the axis of the shaft.

Other and further objects of the present invention will become apparent to those skilled in the art upon a study of the following specification, appended claims, and accompanying drawings.

BRIEF DESCRIPTION OF THE DRAWINGS

FIG. 23 is a perspective view of a still further modified form of the ball striking head, with a segment only of the shaft being illustrated, the balance being cut away;

FIG. 24 is a top plan view of the ball striking head illustrated in FIG. 23, with the shaft further being shown as cut away;

FIG. 25, 26, 27 and 28 are front elevational, bottom plan, side elevational and rear elevational views respectively of the ball striking head illustrated in FIGS. 23 and 24, and with the shaft being shown cut away in each instance;

FIG. 29 is a perspective view of a still further modified form of the ball striking head, with a segment only of the shaft being illustrated, the balance being cut away; and FIGS. 30, 31, 32, 33 and 34 are top plan, front elevational, bottom plan, side elevational and rear elevational views respectively of the ball striking head as illustrated in FIG. 29.

DESCRIPTION OF THE PREFERRED EMBODIMENT

Attention is now directed to the modification of the structure illustrated in FIGS. 1–10 inclusive, wherein the improved golf putter generally designated 10 includes a conventional shaft 11 having a gripping handle 12 at one end thereof and a ball striking head generally designated 13 at the opposed end thereof. A conventional golf ball is illustrated at 14 to show the manner in which the putter is employed prior to striking the ball. The shaft 11 is provided with an angular offset portion as at 16, with the angular extent of the offset being 15° from the axis of the main portion of the shaft 11, the main portion being illustrated at 17 for example.

Figure 1:
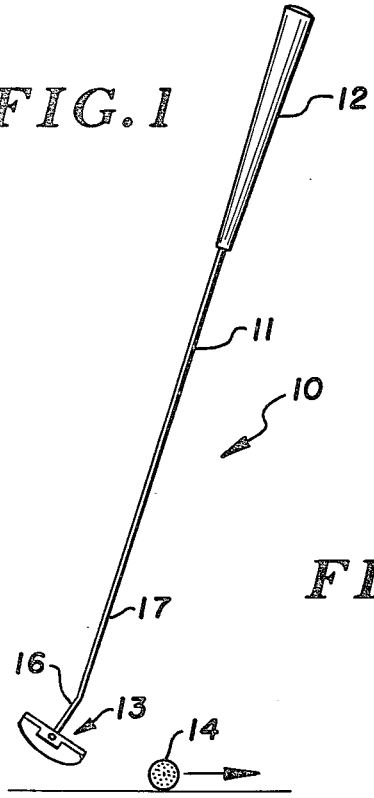
FIG. 1 is a rear elevational view of the club of the present invention, with the view being taken from the golfers side of the club, and illustrating the angular offset which is normally desired to accommodate the club.
Figure 2:
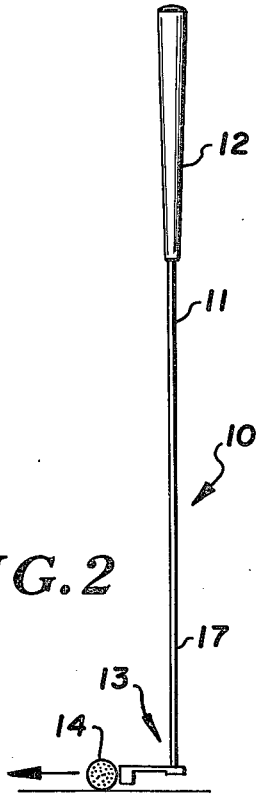
FIG. 2 is a side elevational view of the golf putter illustrated in FIG. 1.
Figure 3:
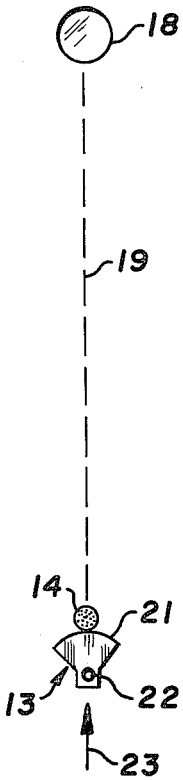
FIG. 3 is a fragmentary view of the club illustrating the ball striking head only, and illustrating the relationship between the ball striking head and the ball as it is normally directed toward the cup, with the cup being illustrated, and the preferred direction of the golf ball being shown as a broken line.
Figure 4:
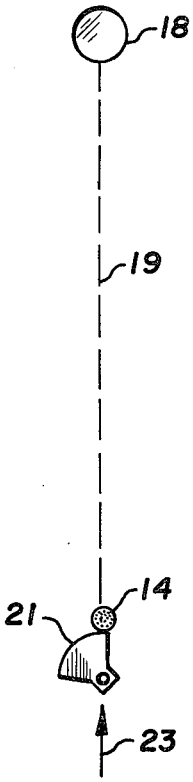
FIG. 4 is a view similar to FIG. 3, and illustrating, on a slightly exaggerated form, the manner in which the improved golf putter of the present invention strikes the ball in response to an inadvertent twist of the shaft by the golfer.
Figure 5:
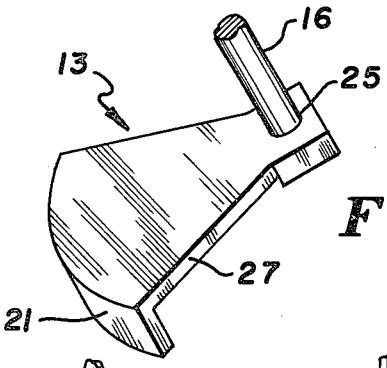
FIG. 5 is a perspective view of the ball striking head and a segment only of the shaft, with this view being on a slightly enlarged scale.
Figure 6:
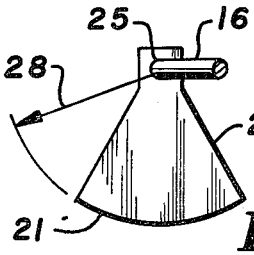
FIG. 6 is a top plan view of the ball striking head of the putter club, and illustrating the shaft in cutaway form.

In FIG. 2, the putter is illustrated as it is about to strike the ball 14, with the views of FIGS. 3 and 4 illustrating the manner in which the ball striking surface engages the ball and directs it to its destination, preferably within the confines of cup 18. The intermittent line 19 shows, as will be appreciated, the preferred path for the ball 14 to take upon being struck by the ball striking surface 21 of ball striking head 13. In FIG. 4, the arrangement is illustrated as it appears when the golfer inadvertently twists the shaft 11 during the putting stroke. In spite of the inadvertent twisting, the portion of ball striking surface 21 which makes contact with ball 14 is, nevertheless, generally such that the directional aspects of the stroke are substantially unaffected. This is due to the fact that the ball striking surface will always have a point which has a tangent generally normal to the preferred direction for the ball 14 to take, with the preferred direction being shown in the broken line 19.

More specifically, shaft engaging bore 22 has its center at a point which is coincident with the center of radius of ball striking surface 21. Therefore, the direction of motion of the club prior to striking the ball as illustrated by the arrow 23 will provide a constant ball striking surface regardless of directional twisting of the shaft of the club during the stroke. When the directional line 23 is projected toward the cup, the point at which the ball striking surface engages the surface of ball 14 will have its tangent along a line generally normal to the direction of motion of the club indicated by line 23 and a projection thereof.

In order to achieve the effect of directional anomalies resulting from twisting of the golf shaft, the axis of the cylindrical segment which forms ball striking surface 21 intersects a plane which extends through the axis of the shaft 11 along the gripping handle portion, and with the said plane being generally parallel to the plane which is tangent of the ball striking surface at the arcuate center thereof. In other words, the plane which is tangent to the ball striking surface at the arcuate center thereof will be, in turn, substantially parallel to a plane which extends through the axis of the shaft along the gripping handle portion thereof. The degree of offset extending between these two planes will preferably be in the area of 2½ inches to 3½ inches, and in some cases, up to 4½ inches, with a radius of substantially three inches having been found to be most generally preferred. Such a radius accommodates most golfers, and further provides an appropriate match between the ball diameter and the radius of arc forming surface 21.

Figure 10:
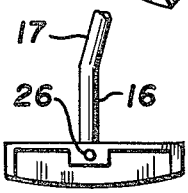
FIGS. 9 and 10 are side elevational and rear elevational views respectively of the ball striking head, with the shaft being, as indicated, partially cut away.
Figure 9:
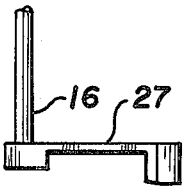
Figure 7:
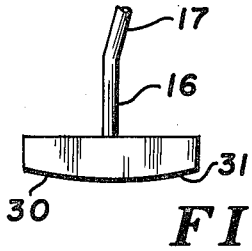
FIG. 7 is a front elevational view of the ball striking head, with a segment only of the shaft being illustrated.
Figure 8:
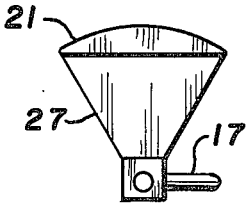
FIG. 8 is a bottom plan view of the ball striking head, and with only a portion of the shaft being illustrated.
Figure 11:
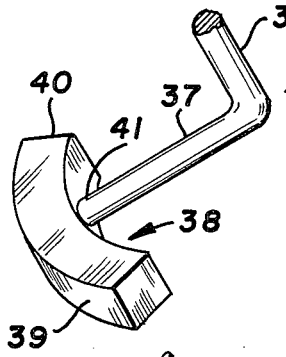
FIG. 11 is a perspective view of a modified form of the ball striking head, and showing the engagement between the ball striking head and the shaft, with only a segment of the shaft being shown.
Figure 12:
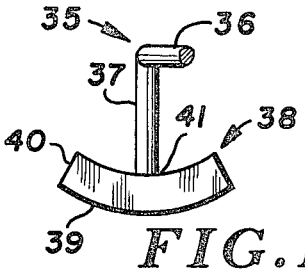
FIG. 12 is a top plan view of the putter shown in FIG. 11, and with the shaft being shown cut away.
Figure 16:
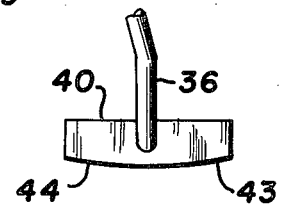
FIGS. 13, 14, 15 and 16 are front elevational, bottom plan, side elevational and rear elevational views respectively of the putter illustrated in FIGS. 11 and 12, with the shaft being cut away in each instance.
Figure 15:
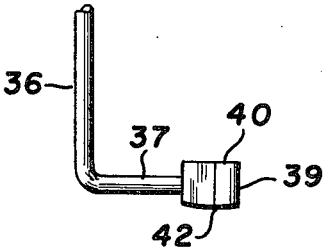
Figure 13:
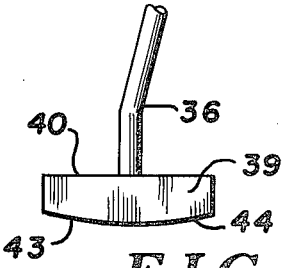
Figure 14:
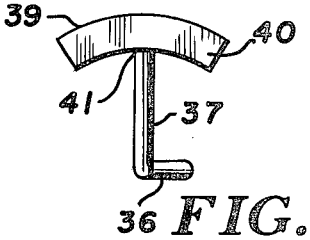
Figure 17:
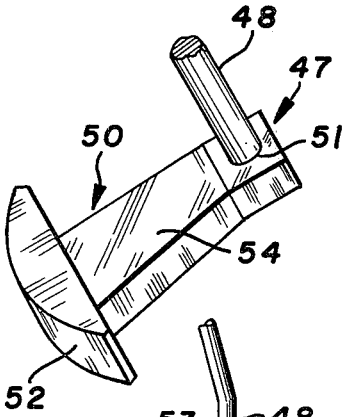
FIG. 17 is a perspective view of a modified form of the ball striking head, and illustrating a portion only of the shaft, with the balance being cut away.
Figure 18:
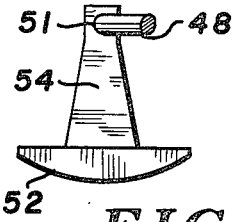
FIG. 18 is a top plan view of the ball striking head illustrated in FIG. 17, and further illustrating the shaft as being cut away.
Figure 22:
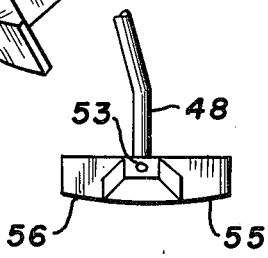
FIGS. 19, 20, 21 and 22 are front elevational, bottom plan, side elevational and rear elevational views respectively of the putter illustrated in FIGS. 17 and 18, with the shaft being shown broken away in each instance.
Figure 21:
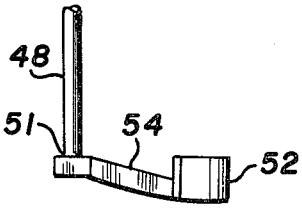
Figure 19:
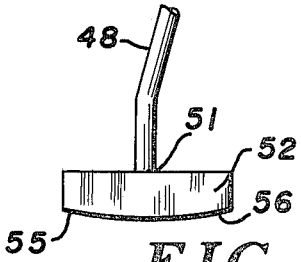
Figure 20:
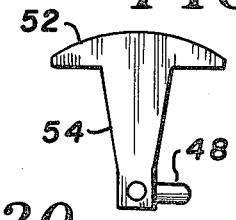

Turning further to the details of the structure, and with particular reference to FIGS. 5–10 inclusive, shaft portion 16 engages ball striking head 13 in a bore formed in ball striking head 13 as at 25. Bore 25 may further be provided with a set screw arrangement or the like as illustrated in FIG. 10, as at 26. Ball striking head 13 has a plate or web portion 27 which extends to and terminates along ball striking surface 21. As is apparent, ball striking surface 21 forms a cylindrical segment of substantially constant radius, with the radius of the cylindrical segment being, in turn, coincidental with the axis of shaft engaging bore 25. As has been indicated, the extent of the offset, or in other words, the magnitude of the radius of the cylindrical segment forming surface 21 is preferably three inches, although a range of from 2½ inches to 4½ inches may be useful. Such a radius provides a match of proper use for the ball striking surface and the normal golf ball diameters, as well as accommodating the individual differences between most golfers. The radius line is shown at 28 in FIG. 6.

In order to accommodate an anti-scuffing arrangement for the putter, the cylindrical surface 21 is relieved at the lateral base edges, as illustrated at 30 and 31 respectively. This anti-scuffing arrangement, while not being essential, is preferred because of the extent of offset between the ball striking surface and the shaft.

Attention is now directed to the modified form of golf putter illustrated in FIGS. 11–16 inclusive, wherein the structure shown generally at 35 includes a shaft portion 36 having a laterally offset portion 37 extending therefrom and engaging the rear portion of ball striking head generally shown at 38. The offset portion 37 provides, as can be appreciated, the offset between the axis of the cylindrical segment forming the ball striking surface 39 and the plane which extends through the axis of the shaft along the gripping handle portion and generally parallel to the tangent of the arcuate center of surface 39. Specifically, ball striking head 38 has a body portion 40 which terminates along ball striking surface 39, and further has a bore formed therein as at 41 for receiving the end of offset portion 37 of shaft 36. For anti-scuffing purposes, the bottom surface of ball striking head 38 may be relieved as at 42, and furthermore the lateral base edges may be relieved as at 43 and 44.

Attention is now directed to the further modification illustrated in FIGS. 17–22 inclusive, and wherein the putter generally designated 47 includes a shaft, only a portion of which is illustrated, as at 48, with the shaft engaging ball striking head generally shown at 50 in a bore formed therein as at 51. A ball striking surface 52 is shown at the forward end of the ball striking head 50, and as has been stated previously in connection with the other embodiments, the surface 52 is generally in the configuration of a cylindrical segment of substantially constant radius. Also, the axis of the cylindrical segment forming the ball striking surface intersects a plane which extends through the axis of the shaft along the gripping handle portion and generally parallel to the tangent of the ball striking surface 52 at the arcuate center thereof. As has been suggested in connection with the embodiments of FIGS. 1–10, a set screw may be provided as at 53 for securing the ball striking head 50 to the shaft 48. In order to achieve some further offset arrangement, if desired, the surface 52 may be offset a certain amount beyond the end of the shaft, as provided by the offset linking arrangement or web shown at 54. Also, the lateral base edges are relieved as at 55 and 56 to avoid scuffing.

Attention is now directed to that embodiment illustrated in the drawings at FIGS. 23–28 inclusive. In this embodiment, the putter generally designated 60 includes a shaft portion 61, only a segment of which is illustrated, along with a ball striking head shown generally at 62. Ball striking head 62 is provided with a ball striking surface as at 63, with this surface being, as previously suggested, a cylindrical segment. Ball striking surface 63 is designed, as has been indicated previously, so that the axis of the cylinder of which the surface of segment 63 forms a part intersects a plane extending through the axis of the shaft along the gripping handle portion and generally parallel to a plane tangent to the ball striking surface at the arcuate center thereof. The degree of offset extending between the plane of the shaft along the gripping handle portion in the tangent plane is preferably 3 inches, although ranges of between about 2½ inches and 4½ inches may be useful.

Attention is now directed to the embodiment illustrated in FIGS. 29–34, which embodiment is in the form of a putter generally designated 65, and includes a shaft 66, only a segmental portion of which is illustrated, along with ball striking head generally designated 67. Head 67 has a shaft receiving portion as at 68, in which a bore is formed as at 69 for receiving shaft 66 therein. The ball striking head includes a web portion, specifically, a pair of links or arms 70 and 71 which extend outwardly from portion 68 to ball striking surface 72. As has been expressed with the other embodiments, ball striking surface 72 is generally the segment of a cylinder of substantially constant radius, and with the axis of the cylinder intersecting a plane extending through the shaft along the gripping handle portion and generally parallel to a plane which is tangent of the ball striking surface at the arcuate center thereof. As a further feature, ball striking head 67 is provided with a counterbalancing portion as at 74, in order to enhance the overall balance of the club for the golfer.

I claim:

1. A golf putter comprising:

(a) a shaft with a gripping handle at one end thereof;

(b) a ball striking head having a ball striking surface at a lateral edge thereof, said ball striking surface having the general configuration of a segment of a right circular cylinder;

(c) said ball striking head further including a web portion integrally connected to said ball striking surface and at least partially offset from the plane of the lower base of said cylindrical segment;

(d) a bore formed in said web portion at a point coaxial with the longitudinal axis of said cylindrical segment; and (e) means for securing the other end of said shaft in said bore such that the axis of said shaft is coaxial with the longitudinal axis of said cylindrical segment.

* * * * *